US006902450B2

(12) United States Patent
Ohtsuki et al.

(10) Patent No.: US 6,902,450 B2
(45) Date of Patent: Jun. 7, 2005

(54) OUTBOARD MOTOR AND TILLER HANDLE THEREOF

(75) Inventors: Teruhiko Ohtsuki, Wako (JP); Yoshihiro Harada, Wako (JP)

(73) Assignee: Honda Motor Co, Ltd., Tokyo (JP)

( * ) Notice: Subject to any disclaimer, the term of this patent is extended or adjusted under 35 U.S.C. 154(b) by 0 days.

(21) Appl. No.: 10/743,300

(22) Filed: Dec. 23, 2003

(65) Prior Publication Data

US 2004/0137806 A1 Jul. 15, 2004

(30) Foreign Application Priority Data

Dec. 25, 2002 (JP) ..... 2002-375040
Dec. 25, 2002 (JP) ..... 2002-375048
Dec. 25, 2002 (JP) ..... 2002-375052

(51) Int. Cl.[7] ..... B63H 5/125
(52) U.S. Cl. ..... 440/63; 440/84
(58) Field of Search ..... 440/53, 63, 84, 440/87

(56) References Cited

U.S. PATENT DOCUMENTS 4,587,935 A 5/1986 Yamazaki
4,784,624 A 11/1988 Yoshida
5,676,021 A * 10/1997 Campagnolo ..... 74/489
6,093,066 A * 7/2000 Isogawa et al. ..... 440/63
6,253,461 B1 * 7/2001 Fischer ..... 33/762
2001/0032546 A1 * 10/2001 Sharpe ..... 99/331

FOREIGN PATENT DOCUMENTS

| | | |
|---|---|---|
| JP | 51-60099 | 5/1976 |
| JP | 58081894 | 5/1983 |
| JP | 61-62697 | 4/1986 |
| JP | 4-218492 | 8/1992 |
| JP | 11208589 | 8/1999 |
| JP | 11-208589 | 8/1999 |

* cited by examiner

*Primary Examiner*—Stephen Avila
(74) *Attorney, Agent, or Firm*—Squire, Sanders & Dempsey L.L.P.

(57) ABSTRACT

A display device 21 for electrically showing a state of an outboard motor according to a sensing result of various sensors is provided to a tiller handle such that a display surface 27 thereof faces in an oblique upward direction. Preferably, the display device is provided on an upper surface 26*a* of a substantially horizontally extending housing 26 of the tiller handle. Further the display device may be received in a projection 28 formed by a protruding part of the upper surface of the housing of the tiller handle.

6 Claims, 16 Drawing Sheets

OUTBOARD MOTOR AND TILLER HANDLE THEREOF

TECHNICAL FIELD

The present invention relates to an outboard motor comprising a propulsion propeller, an engine for driving the propeller and a tiller handle extending from a main body of the outboard motor toward a watercraft body so that the steering of the watercraft body can be conducted by using the tiller handle. Particularly, the present invention relates to an outboard motor in which the tiller handle is provided with a display device for electrically displaying a state of the outboard motor in response to a result of sensing by various sensors.

Further, the present invention relates to a tiller handle of an outboard motor for steering a motor main body which is equipped with a propulsion propeller and a power source for driving the propeller and steerably attached to a watercraft body. Particularly, the present invention relates to a tiller handle of an outboard motor comprising a handle main body supported by a bracket extending from a motor main body toward a watercraft body such that the handle main body is pivotable in an up-down direction and can be held at an arbitrary inclination angle within a prescribed pivot range.

BACKGROUND OF THE INVENTION

Some outboard motors are equipped with a display device for enabling an operator to recognize an abnormal state of cooling water, lubricating oil, etc of the engine. Particularly, in outboard motors where a tiller handle extending from a main body of the outboard motor to a watercraft body is used in steering the motor main body, it is known not only to provide the display device to a side of the main body of the outboard motor but also to provide the display device to the tiller handle which is closer to the operator, so that the display device is visible by the operator near the outboard motor (see Japanese Patent Application Laid-Open Publication No. 11-208589, for example).

Such a display device is generally configured to indicate the abnormality of the outboard motor by turning on a lamp, and has a lens on a surface of the lamp to improve visibility, which provides a certain view angle range. Besides, a liquid crystal display panel may be used in the display device to indicate various information regarding the state of the outboard motor. In such a case also, the display device will have a certain view angle range.

When the display device is mounted in a side surface of a housing of the tiller handle in such a manner that its display surface is substantially flush with the side surface of the housing, the operator will see the display surface of the display device obliquely from above and the view angle range of the display device cannot be fully utilized because part of the view angle range below the display surface will be wasted.

Meanwhile, in outboard motors where steering of a motor main body equipped with a propulsion propeller and a power source (or engine) for driving the propeller is conducted by using a tiller handle, the tiller handle (more specifically, a handle main body) may be supported by a bracket extending from the motor main body such that the handle main body is pivotable in an up-down direction whereby the handle main body may pivot from an operating position in which a center line of the handle main body extends in a substantially horizontal direction to a collapsed position in which the handle main body extends along the motor main body.

In the collapsible tiller handle as above, it is known to connect a base end of the handle main body and a free end of the bracket to each other by a lateral bolt which functions as a pivot shaft, wherein a nut is threadably engaged to the bolt to produce an axial tightening force which in turn can generate a frictional force for holding the handle main body at an arbitrary angle within a predetermined pivot range (see Japanese Patent Application Laid-Open No. 4-218492, for example).

In such a tiller handle capable of steadily holding the handle main body, it is desirable that a structure is provided for keeping a predetermined tightening force by the nut for an extended period of time. However, such a structure can increase an axial dimension of the hinge portion, which may undesirably increase a width of the handle. Further, a tightening process in assembly may be cumbersome and thus lower the work efficiency.

The tiller handle may be equipped with various component parts, such as a shift lever, for improving operability. In a case where connection members for connecting these component parts to the motor main body, such as Bowden cables and wire harnesses, are drawn out from the handle main body near the bearing portion of the pivot shaft, it is also required to take into account the way of arrangement of the connection members when designing the structure around the pivot shaft.

Further, in outboard motors where a steering operation of the motor main body is conducted by using a tiller handle, it is customary to provide a load adjustment device for adjusting a load applied upon the steering operation conducted by an operator using the tiller handle. A known load adjustment device is constituted by a slide plate and a slide resistance adjustor for pressing a friction member against the slide plate to produce a desired slide resistive force, whereby the slide resistive force generated between the slide plate and the slide resistance adjustor along with a steering movement of the motor main body about a steering axis achieves a desired operational load (see Japanese Utility Model Application Laid-Open No. 51-60099, for example).

It such a load adjustment device, the slide plate can be attached to one of a member on the motor main body and a member on the attachment bracket, and the slide resistance adjustor is attached to the other of the members by suitable tightening means such as a blot or the like. However, in a structure where the slide plate is bolted to left and/or right side of the member on the motor main body as in the above mentioned conventional outboard motor, a positioning process for aligning a threaded bolt hole in the motor main body with a threaded bolt hole in the slide plate can be cumbersome, resulting in a complicated assembly work and increase in the number of steps required and hence leading to a higher cost. Thus, a structure that can allow easy positioning is desired.

Further, in the above slide resistance adjustor for producing a desired slide resistance by pressing the friction member against the slide plate, if a proper positional relationship between the friction member and the slide plate is not achieved in the direction of pressing of the friction member against the slide plate, it becomes difficult to adjust the slide resistive force to a desired value, which would hinder a smooth movement of the slide plate with respect to the slide resistance adjustor. Therefore, it is required to precisely control the attachment position of the slide plate in the direction of pressing, and it will be desirable to provide a structure that can facilitate such control of position of the slide plate.

BRIEF SUMMARY OF THE INVENTION

In view of such problems of the prior art, a primary object of the present invention is to provide an outboard motor adapted to effectively utilize the view angle range of the display device for electrically display the state of the outboard motor.

A second object of the present invention is to provide a handle of an outboard motor comprising a collapsible tiller handle that can pivot around a pivot shaft, wherein the handle can ensure a stable position holding capability for an extended period of time while suppressing increase in the axial dimension that would lead to increase in the handle width, and wherein the handle is adapted to improve efficiency in assembly thereof.

A third object of the present invention is to provide an outboard motor which, in an assembly process, can allow easy positioning of the slide plate for constituting the load adjustment device for adjusting a load applied upon a steering operation using the tiller handle, and which can facilitate control of position of the slide plate in the direction of pressing of the slide late.

To achieve the object, according to the present invention, there is provided an outboard motor, comprising: a main body (4) equipped with a propulsion propeller (1) and a power source (2) for driving the propeller and steerably attached to a watercraft body (3); a tiller handle (5, 71, 81) extending from the main body of the outboard motor toward the watercraft body for use in steering the main body of the outboard motor; a sensor (41, 45) for sensing a state of the outboard motor; and a display device (21) for electrically showing the state of the outboard motor according to a result of sensing by the sensor, wherein the display device is provided to the tiller handle such that a display surface (27) thereof faces in an oblique upward direction.

In this way, at least when seen in the side view, the display surface of the display device can be substantially normal to the line of sight of the operator who usually looks down the display obliquely from above, thereby allowing an effective use of the up-down view angle range of the display device.

In the above outboard motor, the display device (21) may be provided on an upper surface **(26*a*, 72*a*, 82*a*) of a substantially horizontally extending part (26, 72, 82) of the tiller handle (5, 71, 81)**. In such a structure, the tiller handle does not interfere with a left-right view angle range of the display device, thus allowing an effective usage of the left-right view angle range of the display device.

In the above outboard motor, the display device (21) may be arranged such that the display surface (27) thereof faces toward a free end of the tiller handle (5). In such a structure, the view angle range of the display device can be effectively used if the operator moves away from the normal steering position to various places in the watercraft.

In the above outboard motor, the display device (21) may be placed at a position in the substantially horizontally extending part (26) of the tiller handle (5) close to a base end of the tiller handle.

In the above outboard motor, the display device (21) may be arranged such that the display surface (27) thereof faces toward an operator when the operator is at a normal operating position. In such a structure, the view angle range of the display device can be effective to the operator who may move or change the posture within a vicinity of the normal steering position.

In the above outboard motor, the display device (21) may be located at a position in the substantially horizontally extending part (82) of the tiller handle (81) close to a free end of the tiller handle.

In the above outboard motor, it is possible that part of an outer surface **(26*a*, 72*a*, 82*a*) of a housing (26, 72, 82) constituting the substantially horizontally extending part of the tiller handle (5, 71, 81) protrudes outwardly to form a projection (28, 73, 83), and at least part of the display device (21)** is received in the projection. In this way, a space for installing the display device in the housing can be easily obtained even when user-operating parts such as a shift lever or ignition switch are provided to the tiller handle.

According to another aspect of the present invention, there is provided a handle of an outboard motor, comprising: a handle main body (5); a bracket (14) extending from a motor main body (4) toward a watercraft body to support the handle main body via a pivot shaft (15) such that the handle main body is pivotable around the pivot shaft in an up-down direction; a friction member (161) fitted on the pivot shaft to create a desired frictional force against the pivoting movement of the handle main body in response to a tightening force along an axis of the pivot shaft; and a pair of inner and outer nuts (171, 172) engaged to a threaded portion (166) formed in the pivot shaft in a mutually pressing state, wherein an outer end surface **(163*a*) of a bearing portion (163) on a side where the nuts are disposed is formed with an opening of a bearing bore (179) to allow the inner nut (171) to be relatively unrotatably received in the bearing bore, and wherein an intervening member (181)** is disposed in the bearing bore and fitted on the pivot shaft to transmit an axial tightening force produced by the nuts to the friction member.

In this way, because the double nut tightening structure can reliably prevent loosening of the nuts and the inner nut is received in the bearing bore, it is possible to ensure a stable tightening force for an extended period of time while suppressing increase in an axial dimension of the joint. Further, the reception of the inner nut in the bearing bore can prevent relative rotation of the nut and thus, in an assembly process, it is only required to engage a tool to a portion of the pivot shaft opposite to the threaded portion with which the nut is engaged in order to carry out the tightening, and thus the assembling efficiency is improved.

In the above handle of an outboard motor, it is possible that an outlet (174) for drawing out a connecting member (51, 56, 58) for connecting a component part (18, 31, 32, 33, 34) mounted to the handle main body to a component part in the motor main body is formed in a base portion of the handle main body (5) at a position near the bearing portion, and the nuts are disposed on a side opposite to the outlet with respect to the bearing portion. In this way, the nuts are disposed on a side opposite to that covered by the connecting member such as a Bowden cable or wire harness, allowing the tightening of the outer nut to be carried out without being hindered by the connecting member. Further, because the inner nut is received in the bearing bore, the height of the nut projecting out from the side surface that is not covered by the connecting member can be minimized, resulting in an improved appearance around the tiller handle.

Further according to this structure, since an intervening member is disposed together with the nuts on a side opposite to the outlet for the connecting member, the friction member is accordingly offset toward the outlet for the connecting member. Thus, even when the forwardly extending bracket is offset from a center line of the motor main body for layout reasons, such as that an inlet for allowing the connecting member from the handle main body to be passed into the motor main body need be located lateral to the bracket, bearing sections that substantially achieve the bearing function about the friction member can be offset toward a center line of the motor main body, improving an operability of the handle main body when it is used in steering operations or pivoted in the upward direction.

Other and further objects, features and advantages of the invention will appear more fully from the following description.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
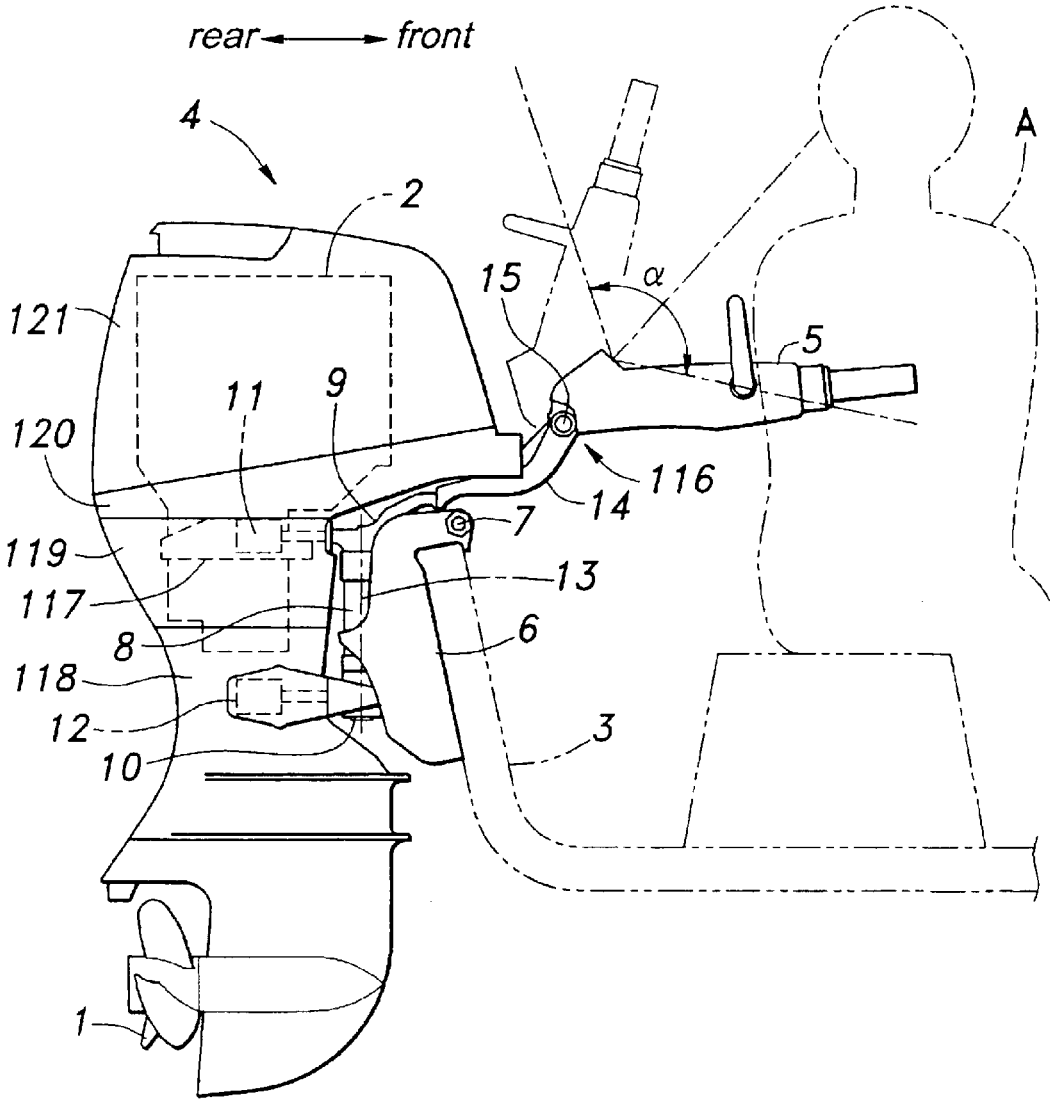
FIG. 1 is a side view for showing an overall structure of an outboard motor according to the present invention.

FIG. 1 is a side view for showing an overall structure of an outboard motor according to the present invention. This outboard motor comprises a propulsion propeller 1, an engine (power source) 2 for driving the propeller 1, a motor main body 4 steerably attached to a watercraft body 3 via an attachment bracket 6, and a tiller handle 5 extending toward the watercraft body 3 to steer the motor main body 4.

The attachment bracket 6 is coupled to a swivel case (a member on the attachment bracket) 8 so as to be pivotable around a lateral tilt shaft 7. The swivel case 8 comprises a cylindrical part for pivotally supporting a vertical swivel shaft, and a mount frame (a member on the motor main body) 9 is attached to an upper end of the swivel shaft while a lower mount housing 10 is attached to a lower end of the same. The mount frame 9 and the lower mount housing 10 are fastened to an engine mount case 117 and extension case 118 via oscillation dampers 11, 12 consisting of elastic members provided to rearwardly extending bolt portions of the frame 9 and housing 10, respectively, so that the motor main body 4 can be steered around a center axis (steering axis) 13 of the swivel shaft. The engine mount case 117 is covered by an under cover 119, over which an engine cover 121 is attached via an extension case 120.

The tiller handle 5 is joined via a handle bracket 14 to the mount frame 9 which is connected to the main body 4 of the outboard motor. The handle bracket 14 supports the tiller handle 5 (more specifically a main body of the tiller handle 5) so as to be pivotable around a lateral joint shaft 15. A joint 116 between the tiller handle 5 and the bracket 14 is provided with a hinge mechanism for allowing the tiller handle 5 to be pivoted upwardly from an angular position shown by solid lines in FIG. 1 (an operating position), and to be held at an arbitrary inclination angle. In the operating position, a center line of the tiller handle 5 extends in a substantially horizontal direction, and by moving the tiller handle 5 in a left or right direction, the motor main body 4 can be rotated left or right around the center line 13 of the swivel shaft to a desired steering angle.

Figure 2:
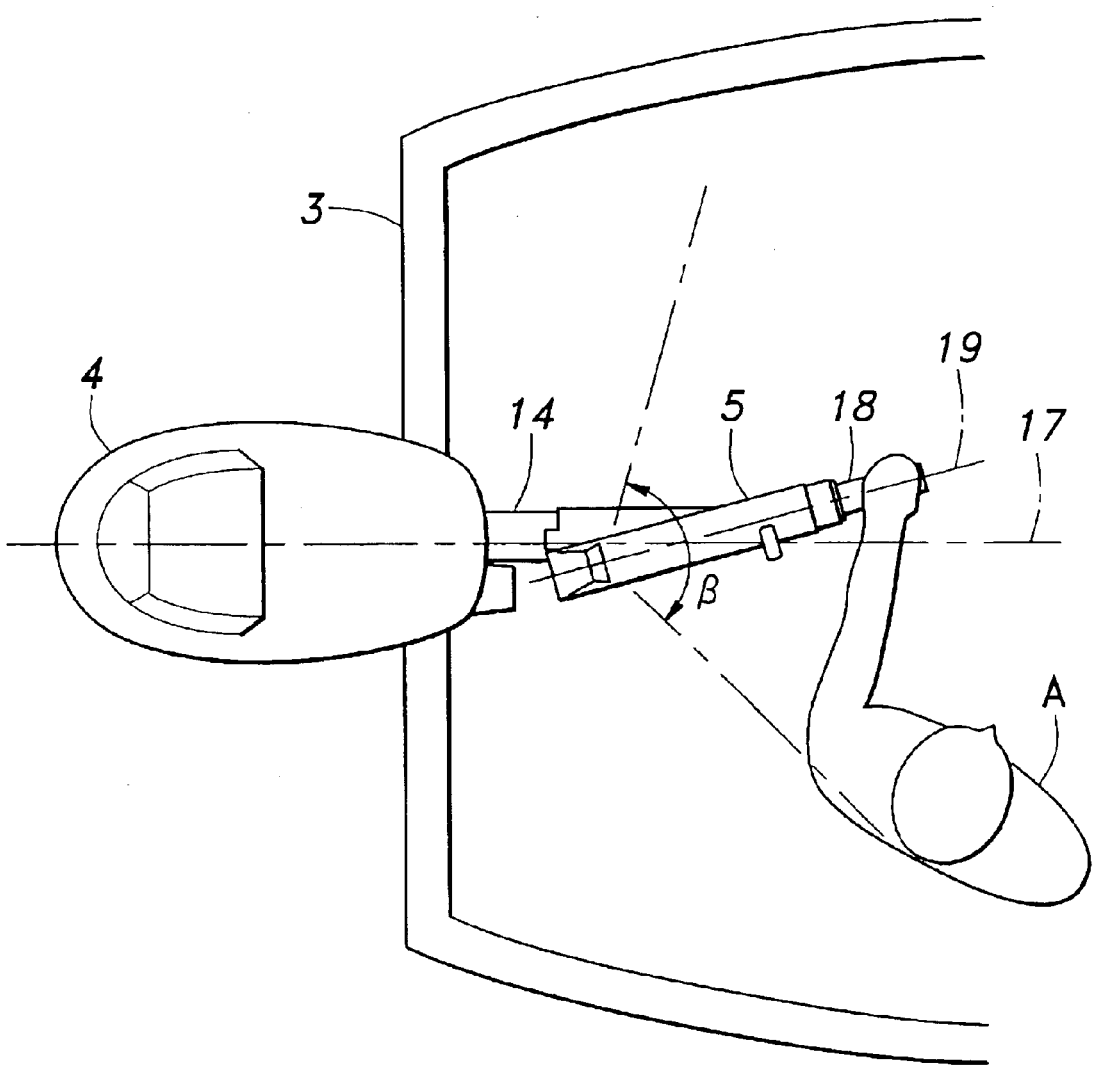
FIG. 2 is a top plan view of the outboard motor shown in FIG. 1.

FIG. 2 is a top plan view of the outboard motor shown in FIG. 1. The tiller handle 5 is disposed such that its direction of extension, which is represented by a center line 19 of a grip 18 provided at a free end of the tiller handle 5, is inclined with respect to a fore and aft center line 17 of the motor main body 4 in the plan view. An operator A is to sit or stand at a position on a side of the center line 17 of the motor main body 4 opposite to the direction of extension of the tiller handle 5 (right side in this embodiment) and conducts steering operations. At some times the operator may leave the normal steering position and move to other places in the watercraft body 3.

Figure 3:
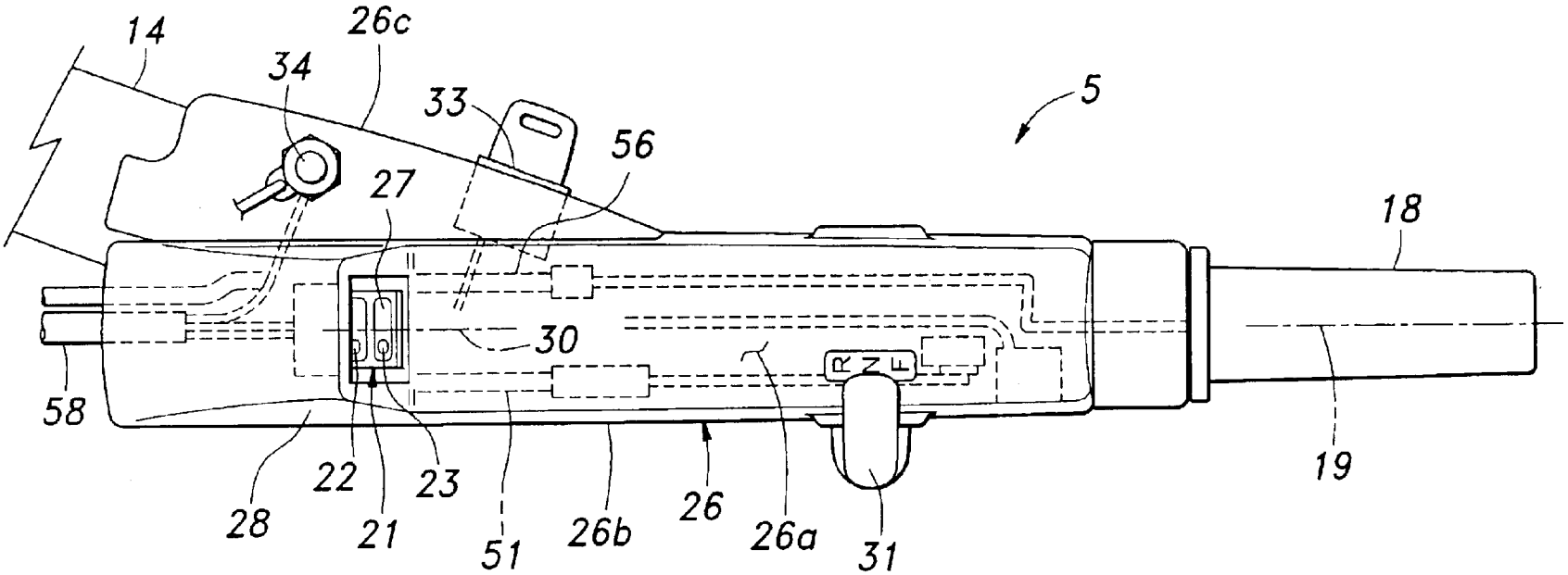
FIG. 3 is a top plan view for showing a first embodiment of a tiller handle to which the present invention is applied.
Figure 4:
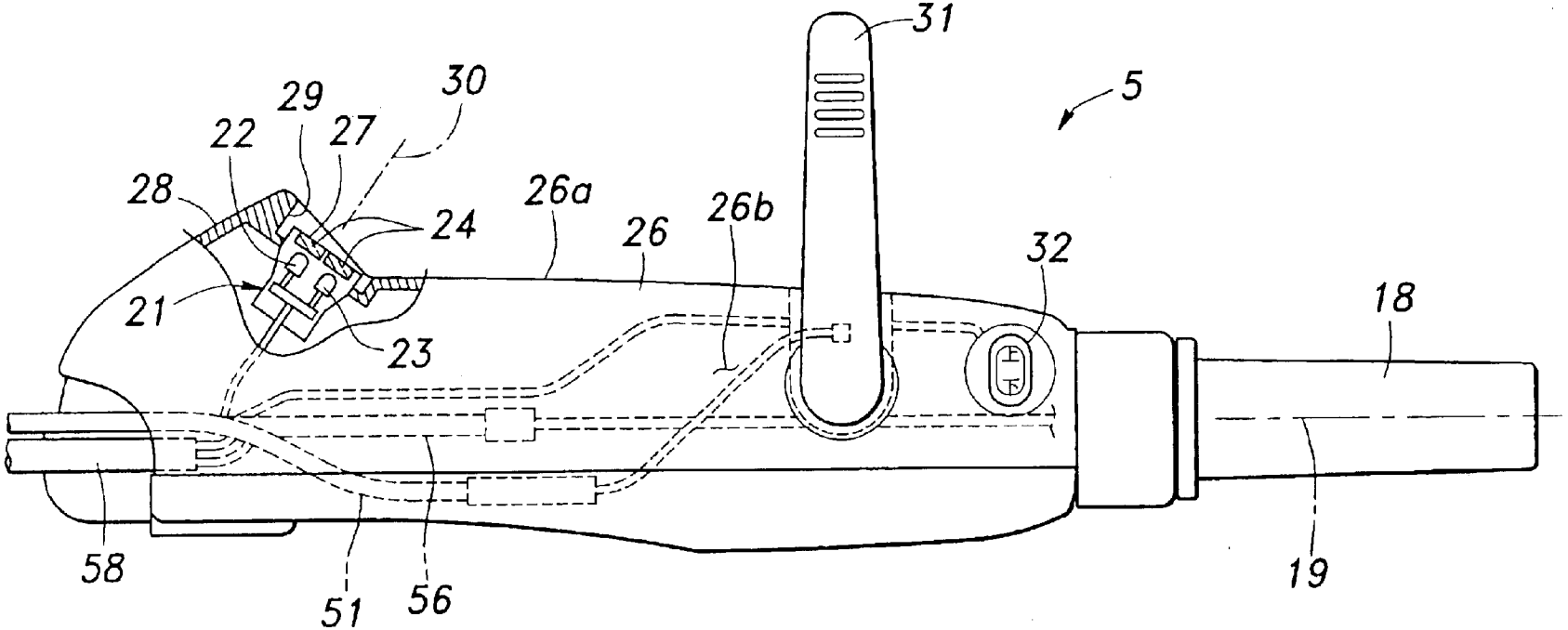
FIG. 4 is a side view of the tiller handle shown in FIG. 3.

FIG. 3 is a top plan view for showing a first embodiment of a tiller handle according to the present invention. FIG. 4 is a side view of the tiller handle shown in FIG. 3. The tiller handle 5 is equipped with a display device 21 for electrically showing a state of the outboard motor. The display device 21 comprises two indicator lamps 22, 23 for indicating abnormal lubricating oil pressure and abnormal cooling water temperature, respectively, and each lamp consists of a light emitting diode and is provided with a lens 24 on a front side thereof.

The display device 21 is provided on an upper surface 26*a* of a housing (or a part extending in a substantially horizontal direction) 26 of the tiller handle 5 such that a display surface 27 thereof stands obliquely in an upward direction. Particularly, in this embodiment, the display device 21 is located at a part of the housing 26 close to a base end of the handle or on a side close to the motor main body 4 such that the display surface 27 faces toward a free end of the tiller handle 5, i.e., a center line 30 of the display surface 27 extends in parallel with the direction of extension (or the center line 19) of the tiller handle 5 when seen in the top plan view.

In this way, as shown in FIG. 1, when seen in the side view the display surface 27 of the display device 21 can be substantially perpendicular to the line of sight of the operator A who usually looks down the display surface 27 obliquely from above. This can allow an effective use of the up-down view angle range of the display device 21, whereby ensuring a favorable visibility even when the operator stands up or moves away from the tiller handle 5 in the frontward direction, for example. Further, as seen in FIG. 2, the tiller handle 5 does not interfere with the left-right view angle range of the display device, allowing the left-right view angle range β to be used effectively so that a favorable visibility can be obtained even when the operator A moves laterally in the watercraft body 3 and leaves the normal steering position, for example.

As shown in FIGS. 3 and 4, the housing 26 of the tiller handle 5 has an approximately rectangular shape in a cross section taken along the lines perpendicular to the center line 19, and the upper surface 26*a* consists of a flat surface extending substantially in a horizontal direction. The display device 21 is mounted in such a way that a part of the display device 21 is received in a convex portion 28 that consists of an upwardly protruding part of the upper surface 26*a* of the housing 26. The convex portion 28 has a cross section having a shape of an inverted V when seen in the side view, and its frontal slanting surface is formed with an opening 29 for exposing the display surface 27 of the display device 21.

On a side surface 26*b* of the housing 26 of the tiller handle 5 facing toward the operator, a shift lever 31 for switching between forward and rearward travels and a tilt switch 32 for a tilt action of the motor main body 4 are provided. On a side surface 26*c* of the housing 26 facing away from the operator, an ignition switch (starter switch) 33 is provided. Further, an emergency stop switch 34 for stopping the engine when the operator falls off from the watercraft is located at a position on the upper surface of the housing 26 close to the base end (or joint 116). The grip 18 provided at the free end of the tiller handle 5 is to be used by the operator when conducting steering operations, and rotation thereof around the center line can adjust throttle opening.

Figure 5:
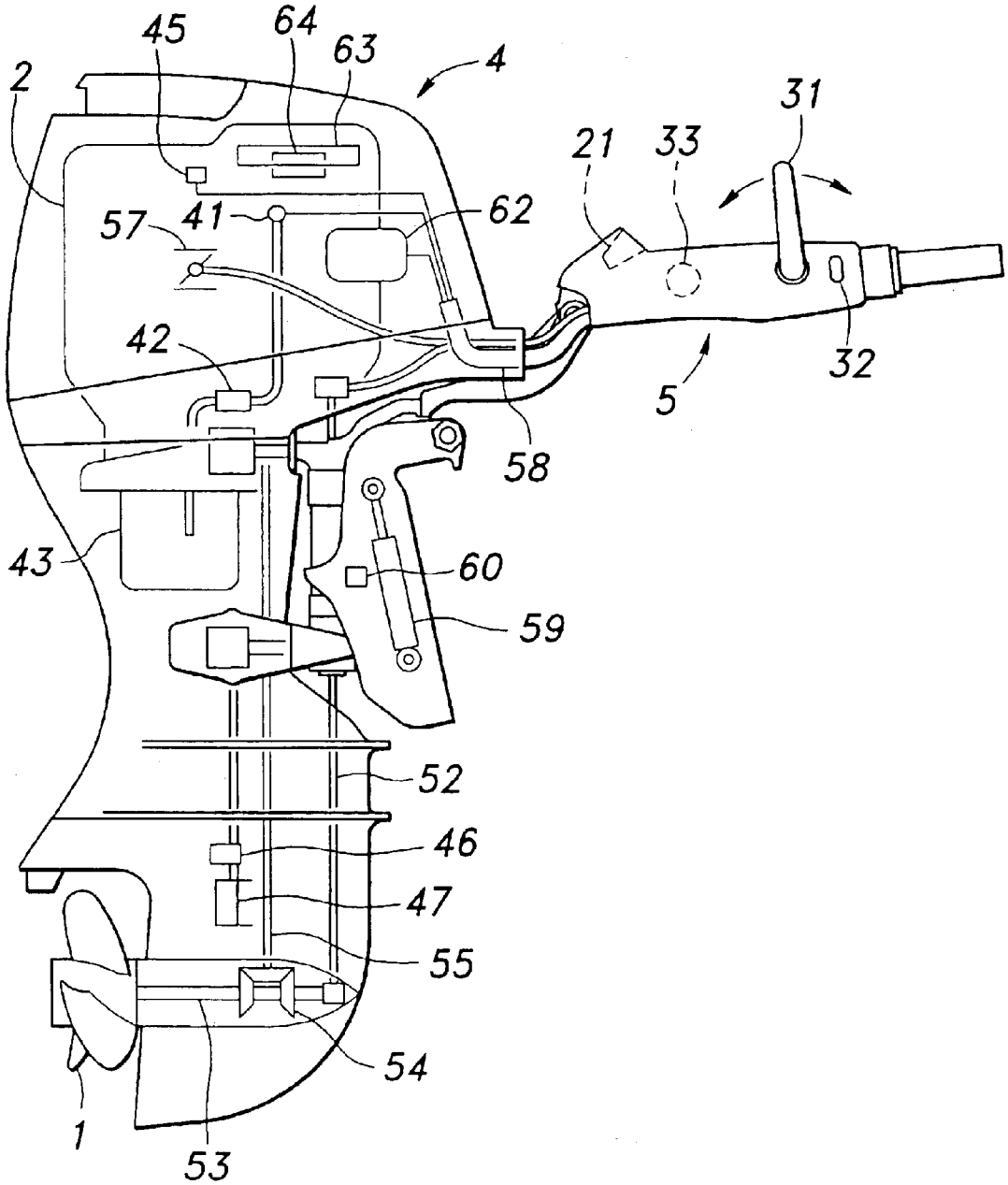
FIG. 5 is a side view for schematically showing component parts relating to the display device and operation parts shown in FIGS. 3 and 4.

FIG. 5 is a side view for schematically showing component parts related to the display device and user-operating parts shown in FIGS. 3 and 4. The lubricating oil pressure abnormality indicator lamp 22 (see FIGS. 3 and 4) in the display device 21 is electrically connected to an oil pressure switch (sensing means) 41 via a lead wire in a wire harness 58. The oil pressure switch 41 senses the pressure of the lubricating oil suctioned from an oil pan 43 and delivered to a cylinder head and the like in the engine 2 by an oil pump 42, and turns on to lighten the lubricating oil pressure abnormality indicator lamp 22 when the lubricating oil pressure becomes below a prescribed value.

The indicator lamp 23 (see FIGS. 3 and 4) for indicating the cooling water temperature abnormality is electrically connected to a thermoswitch (sensing means) 45 disposed within a water jacket of the engine 2 via a lead wire in the wire harness 58. The thermoswitch 45 senses the temperature of the cooling water taken into the water jacket of the engine 2 by a cooling water pump 46 through an inlet 47 located at a lower part of the motor main body 4, and turns on to lighten the cooling water temperature abnormality indicator lamp 23 when the cooling water temperature becomes beyond a predetermined value.

The shift lever 31 is mechanically connected to a gear-clutch mechanism 54, which is coupled to a driving shaft 55 vertically extending from the engine 2, via a shift cable 51 (FIGS. 3 and 4) and a shift rod 52 so that forward and rearward tilting actions of the shift lever 31 from a neutral position can cause the gear-clutch mechanism 54 to change the rotational direction of a propeller shaft 53. The grip 18 (FIGS. 3 and 4) at the end of the tiller handle 5 is mechanically connected to a throttle valve 57 inside the motor main body 4 via a throttle cable 56 (see FIGS. 3 and 4) so that rotating operation of the grip 18 can adjust the opening degree of the throttle valve 57.

The tilt switch 32 is electrically connected to a switch valve 60 of a hydraulically expandable tilt cylinder 59 via a lead wire in the wire harness 58. The ignition switch 33 is electrically connected via a lead wire in the wire harness 58 to a starting switch of a starter motor mounted in the motor main body 4. Further, the emergency stop switch 34 (see FIGS. 3 and 4) is electrically connected via a lead wire within the wire harness 58 to a CDI unit 62 disposed in the motor main body 4. These electric component parts are supplied with electric power by an electric generator 64 provided adjacent to a flywheel 63.

Figure 6:
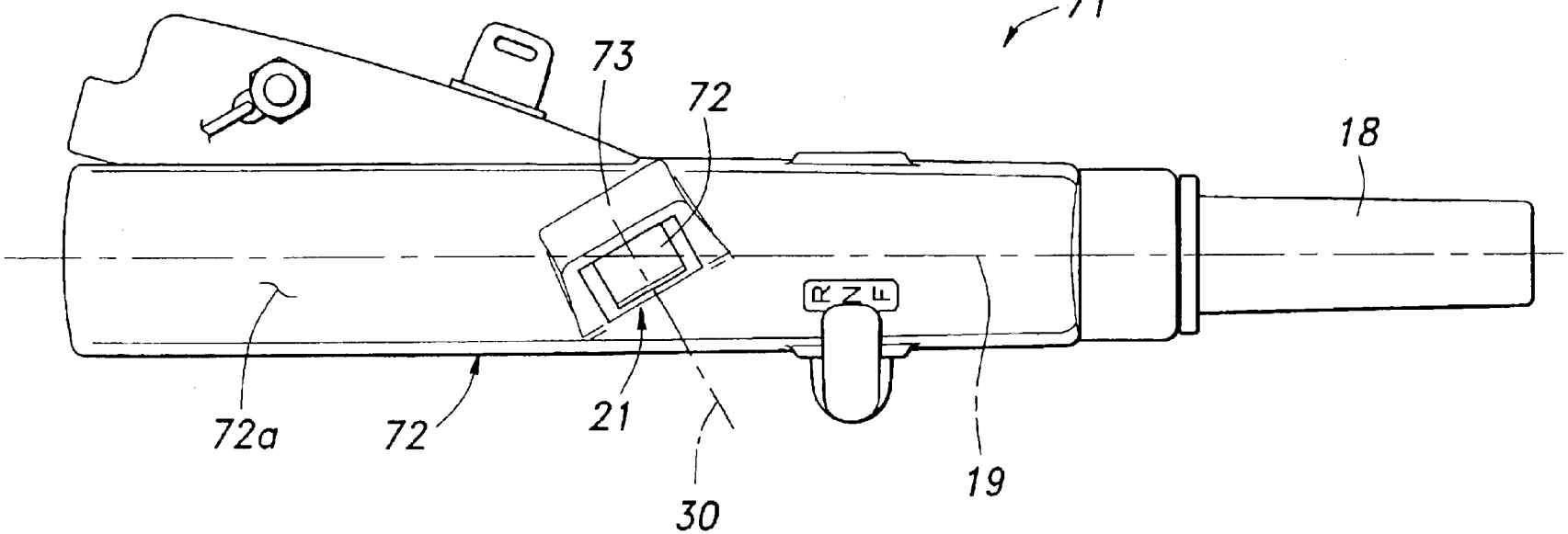
FIG. 6 is a top plan view for showing a second embodiment of a tiller handle to which the present invention is applied.
Figure 7:
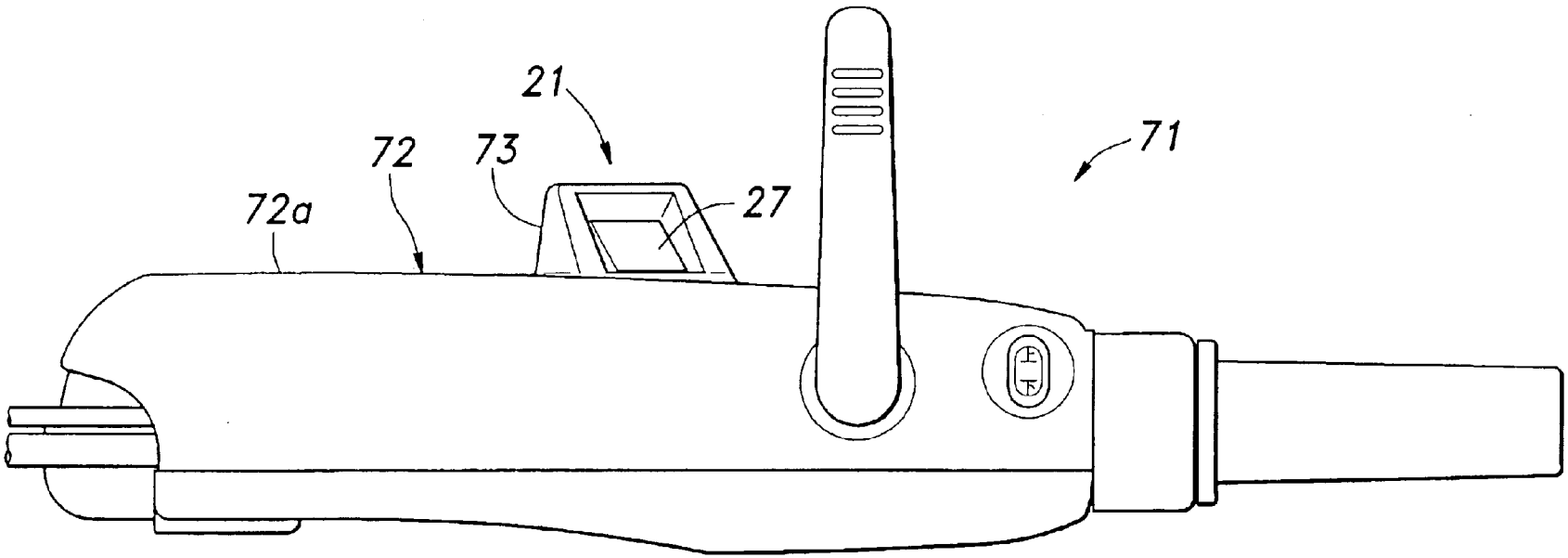
FIG. 7 is a side view of the tiller handle shown in FIG. 6.

FIG. 6 is a top plan view for showing a second embodiment of a tiller handle according to the present invention. FIG. 7 is a side view of the tiller handle shown in FIG. 6. In a manner similar to the first embodiment described above, the display device 21 is disposed in a projection 73 formed on an upper surface 72*a* of a housing 72 such that the display surface 27 stands obliquely in the upward direction. In this embodiment, however, unlike the first embodiment, the display device 21 is located at an intermediate portion of the housing 72 in a direction along the center line 19 such that the display surface 27 faces toward the operator (FIG. 2) at the normal steering position. Particularly in this embodiment, when seen in the top plan view, the center line 30 of the display surface 27 extends obliquely at an angle with respect to the direction of extension (or center line 19) of the tiller handle 71 so that the display surface 27 faces obliquely in the forward direction toward the operator.

Figure 8:
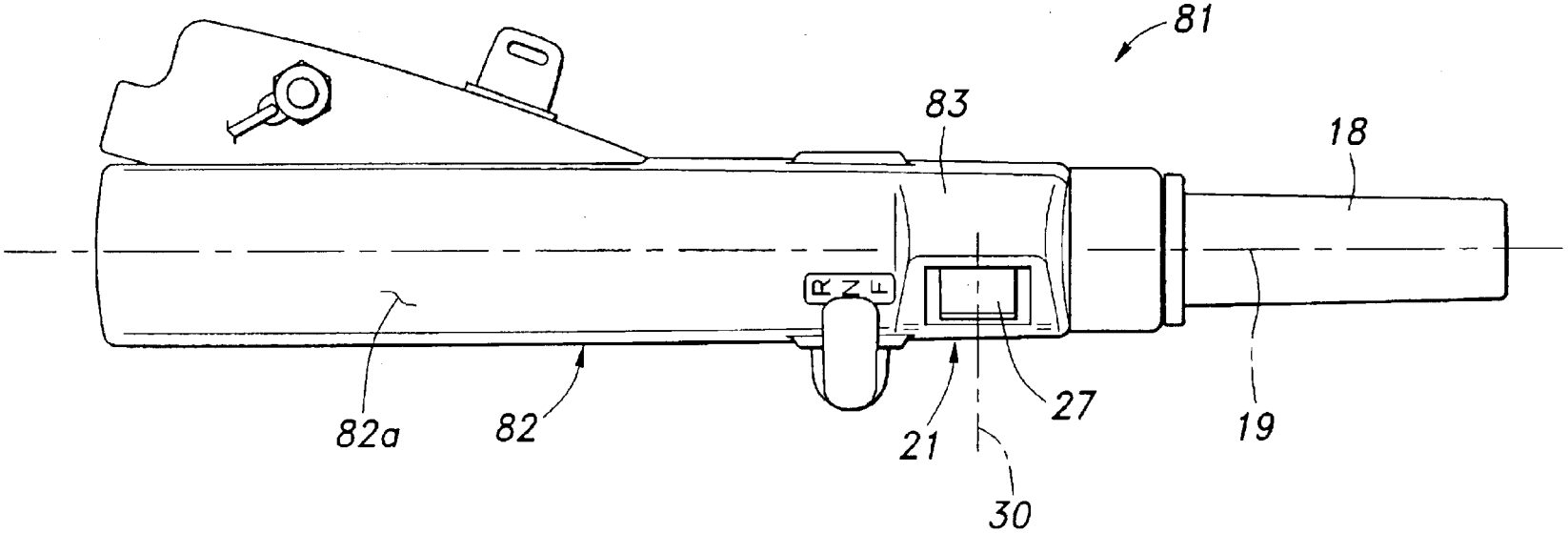
FIG. 8 is a top plan view for showing a third embodiment of a tiller handle to which the present invention is applied.
Figure 9:
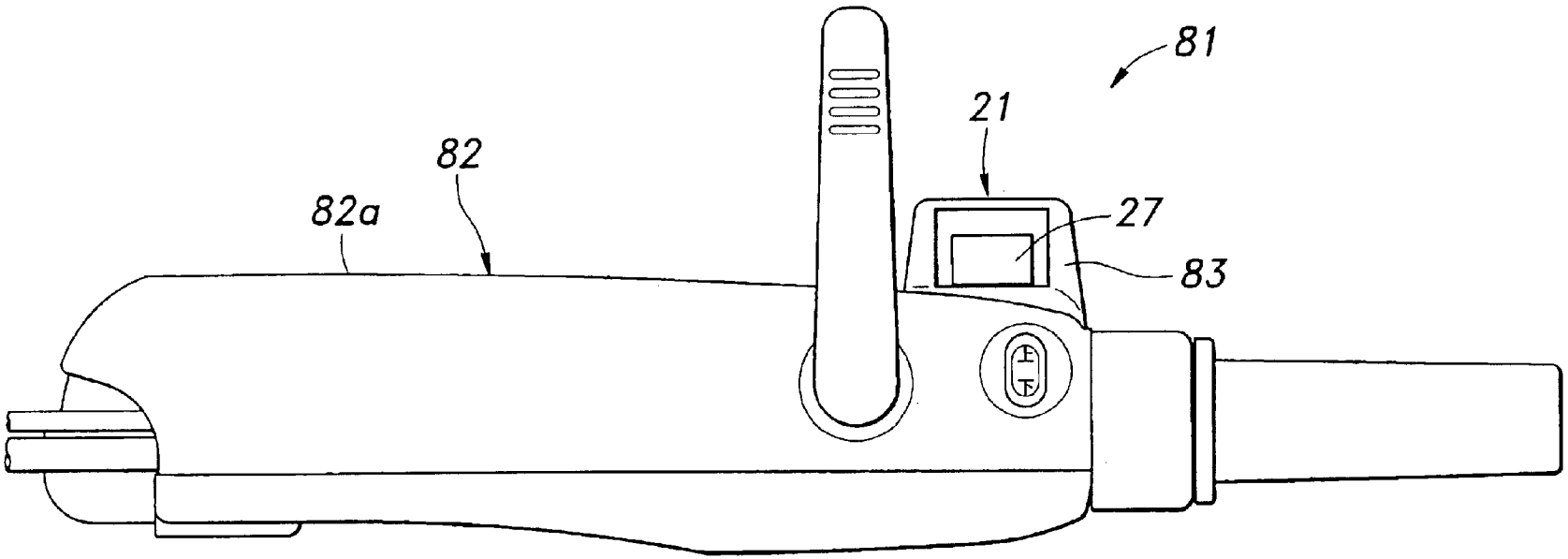
FIG. 9 is a side view of the tiller handle shown in FIG. 8.

FIG. 8 is a top plan view for showing a third embodiment of a tiller handle according to the present invention. FIG. 9 is a side view of the tiller handle shown in FIG. 8. In this embodiment also, like the first and second embodiments described above, the display device 21 is disposed in a projection 83 formed on an upper surface 82*a* of a housing 82 such that the display surface 27 stands obliquely in the upward direction. Further, in a manner similar to the second embodiment, the display device 21 is arranged such that the display surface faces toward the operator. In this embodiment, however, unlike the second embodiment, the display device 21 is located near the grip 18 provided at the free end of the housing 82. Thus, the display device 21 is arranged such that when seen in the top plan view, the center line 30 of the display surface 27 extends substantially perpendicularly to the direction of extension (or center line 19) of the tiller handle 81 so that the display surface 27 faces in a lateral direction toward the operator.

In the above embodiments, the display device comprises two LED indicator lamps for indicating abnormality in the lubricating oil pressure and cooling water temperature, but the display device of the present invention may not be limited to those for indicating such component parts abnormalities, and can be used for displaying an operational state such as a traveling speed or engine rotation speed or information regarding the motor main body such as a tilt/trim angle. Further, the display device may comprise display means other than LEDs, and may comprise a display such as a liquid crystal display (LCD) or a Vacuum Fluorescent Display (VFD). Such displays can show various information in a readily understandable manner by using numeral information and/or changing lightness, color, color saturation, and/or brightness, for example.

Thus, according to the present invention, the display device can be arranged with its display surface facing in an oblique upward direction, thereby making it possible to effectively utilize the up-down view angle range of the display device. Particularly, when the display device is disposed on an upper surface of a substantially horizontally extending part of the tiller handle, it becomes also possible to effectively utilize the left-right view angle range of the display device. Further, when the display device is received in a projection consisting of a protruding part of the upper surface of the housing, a space for mounting the display device in the housing can be easily ensured.

Figure 10:
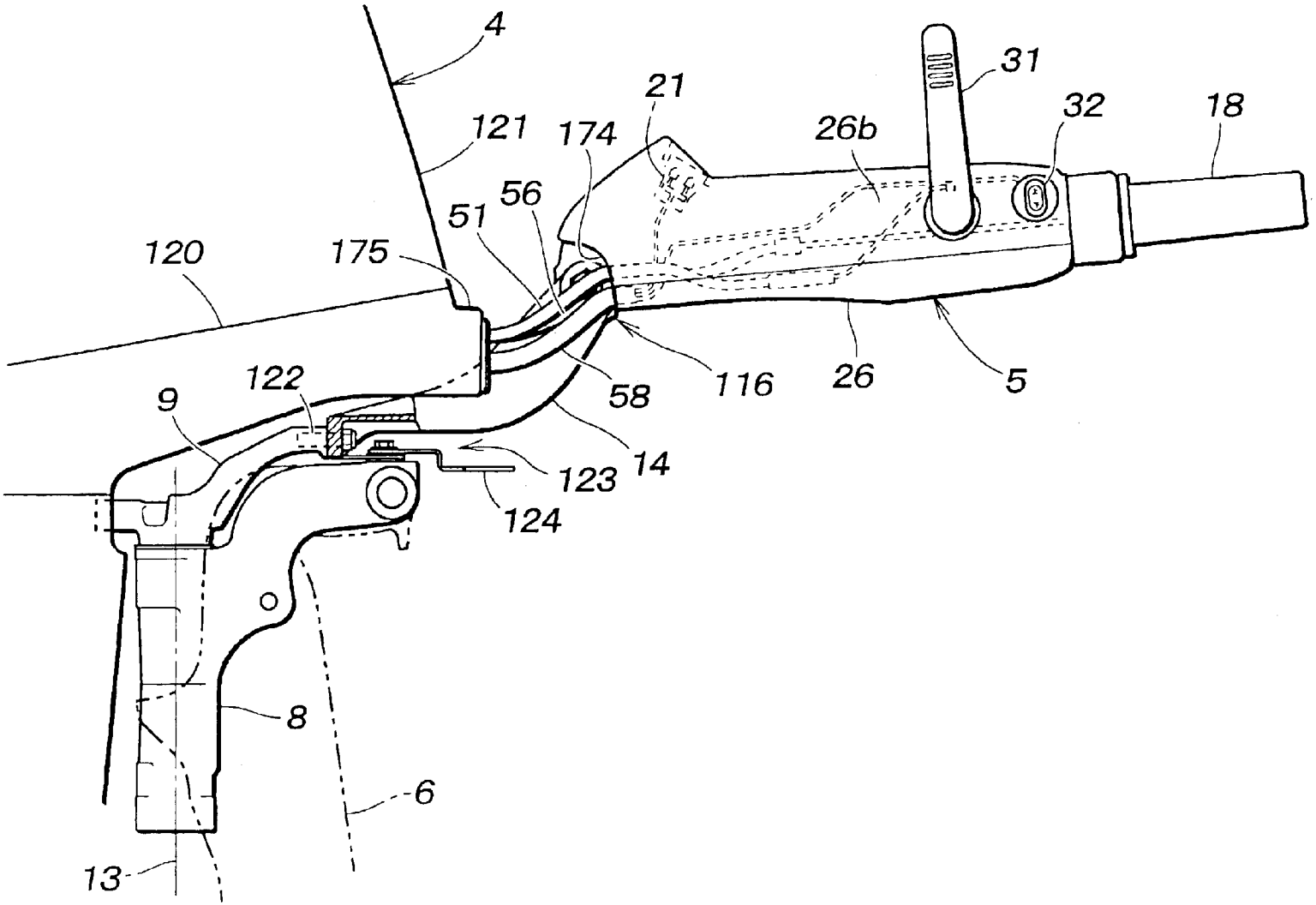
FIG. 10 is a side view for showing the structures around the tiller handle and bracket of FIG. 1 in detail.

FIG. 10 is a side view for showing the tiller handle (or handle main body) and handle bracket shown in FIG. 1 in detail together with their surrounding structure. The handle bracket 14 is fixed to a front end of the mount frame 9 with a bolt 122. Between the swivel case 8 and the mount frame 9 is provided a load control device 123 for adjusting an operation load applied to a steering operation using the tiller handle 5 in such a manner that horizontal rotation of an operation lever 124 can increase/decrease a slide resistance to achieve a desired operation load. The slide resistance may be adjusted so as to lock the steering movement of the motor main body 4 to thereby fix the motor main body 4 at a desired steering angle.

Figure 11:
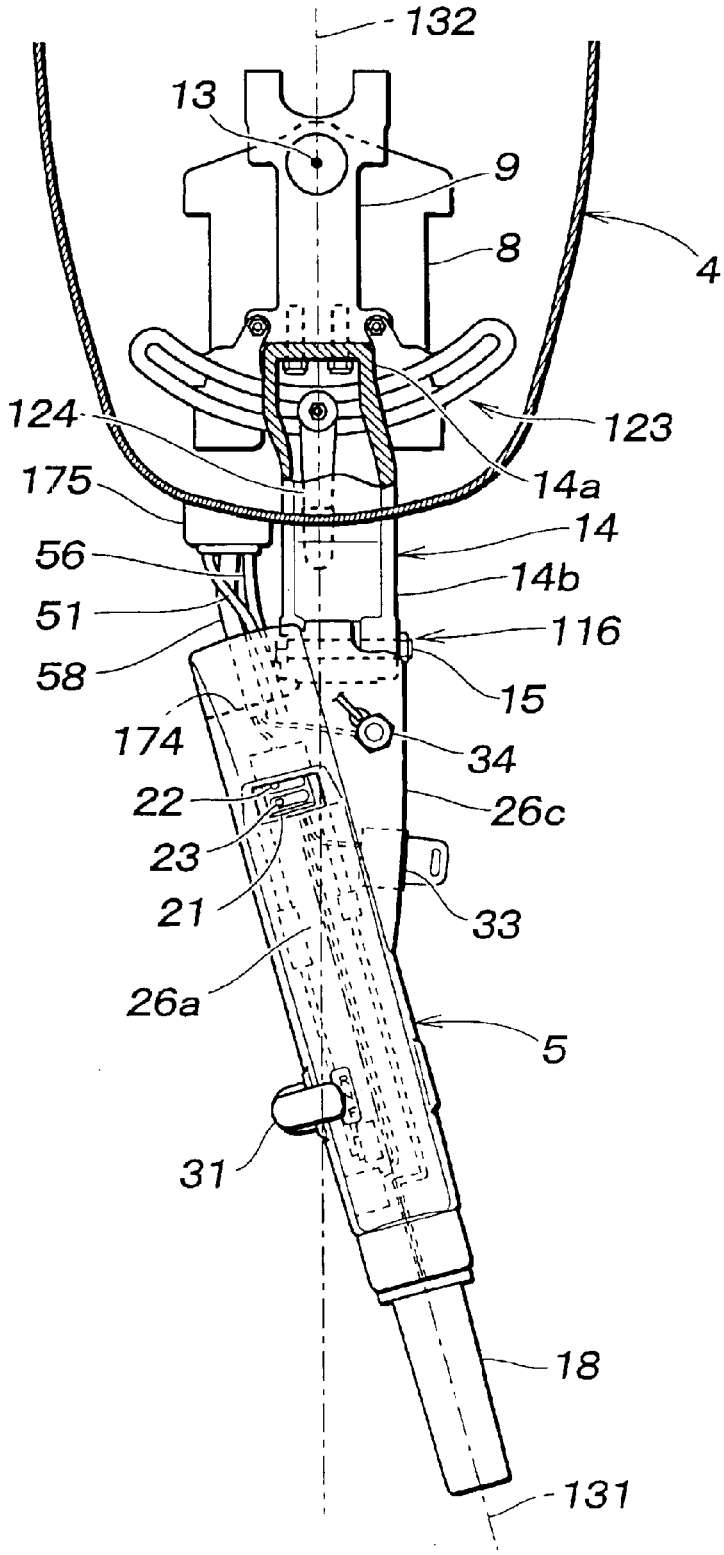
FIG. 11 is a top plan view showing the structures around the tiller handle and bracket of FIG. 1.

FIG. 11 is a top plan view of the structure around the handle main body and bracket shown in FIG. 10. The tiller handle 5 is arranged so that its direction of extension represented by a center line 131 of the grip 18 at the free end thereof is inclined with respect to a fore-and-aft direction center line 132 of the motor main body 4 when seen in the top plan view. The operator is to sit or stand at a position on a side of the center line 132 of the motor main body 4 opposite to the direction of extension of the tiller handle 5 (left side in this drawing) to conduct steering operations.

The handle bracket 14 extends in an upward oblique direction when seen in the side view as shown in FIG. 10, and in the top plan view, it is seen that a base end portion 14*a* of the bracket 14 is connected to the mount frame 9 with its center line being aligned with the center line 132 of the motor main body 4 while a free end portion 14*b* of the same extends forwardly with its center line being offset from the center line 132 of the motor main body 4.

As shown in FIGS. 10 and 11, the shift cable 51, throttle cable 56 and wire harness 58 (connecting members) for connecting the component parts provided on the tiller handle 5 to associated parts in the motor main body 4 are drawn out through an outlet 174 formed in a rear end of the housing 26 of the tiller handle 5 and then, through an inlet 175 formed in a front end of the extension case 120 of the motor main body 4, passed into the inside of the motor main body 4. The inlet 175 is positioned lateral to the bracket 14 so that when the tiller handle 5 is pivoted in the up-down direction as shown in FIG. 1, the shift cable 51, throttle cable 56 and wire harness 58 bend appropriately so as not to hinder the pivoting action of the tiller handle 5. Further, in order not to deteriorate the aesthetic appearance around the tiller handle 5, the inlet 175 is positioned as close to the bracket 14 as possible to minimize the length of exposed part of the connecting members.

Figure 12:
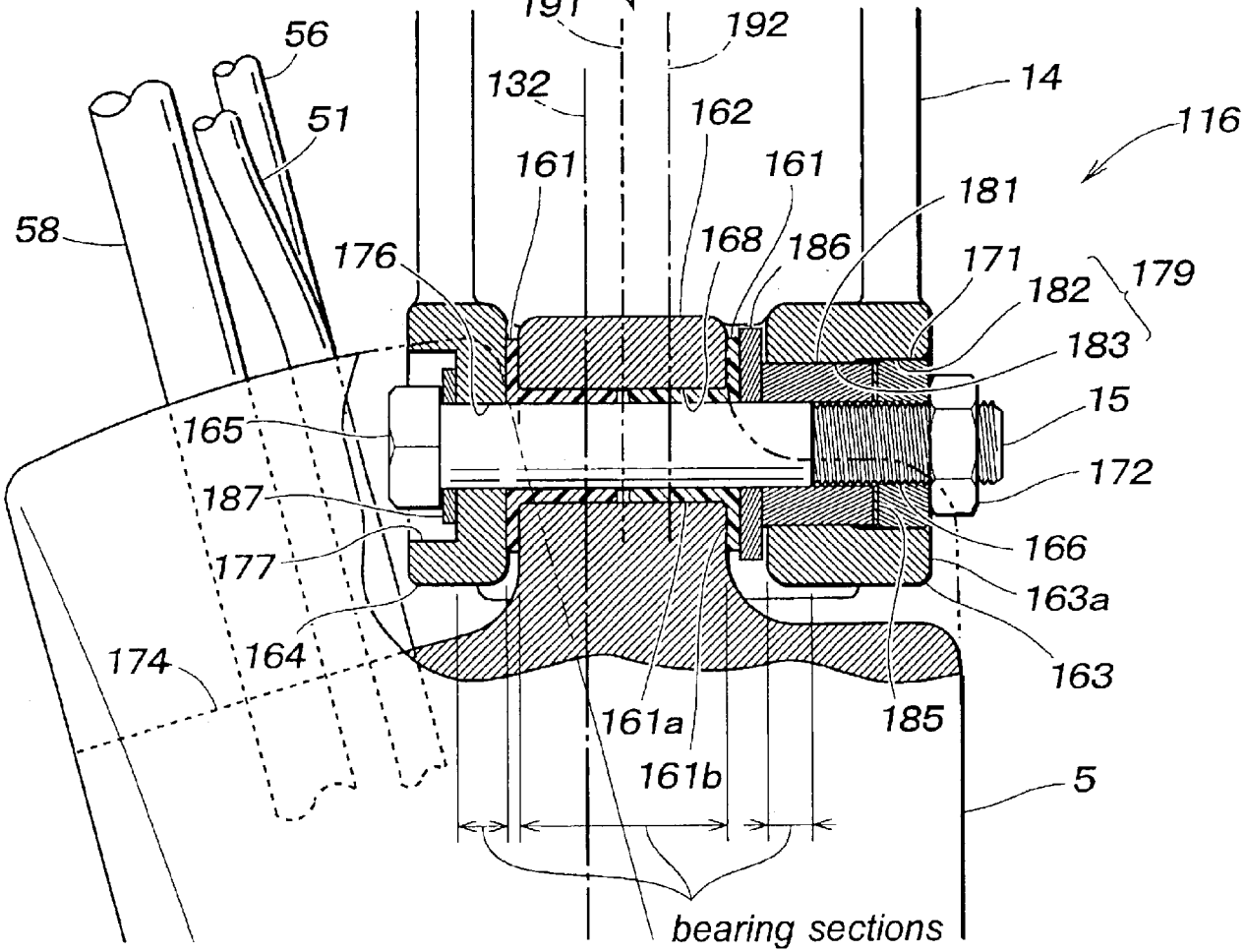
FIG. 12 is a horizontal cross-sectional view for showing the joint between the handle main body and the bracket shown in FIGS. 10 and 11.

FIG. 12 is a horizontal cross-sectional view for showing in detail the joint between the tiller handle and bracket shown in FIGS. 10 and 11. The joint 116 between the tiller handle 5 and bracket 14 comprises bushes (friction members) 161 that are fitted onto the pivot shaft 15 and, in response to an axial tightening force, produce a desired frictional force for stably holding the tiller handle 5 at an arbitrary inclination angle within a predetermined pivot range.

The pivot shaft 15 connects together the tiller handle 5 and the bracket 14 by passing through a bearing portion 162 of the tiller handle 5 and a pair of bearing portions 163, 164 of the bracket 14. One end of the pivot shaft 15 is formed with a head portion 165 having a hexagonal cross-section while the other end of the same is formed with a threaded portion 166. The bearing portion 162 of the tiller handle 5 is shaped to have a convex profile and the pair of bearing portions 163, 164 of the bracket 14 protrude to define a concave profile therebetween so that the bearing portion 162 of the tiller handle 5 can be axially interposed between the bearing portions 163, 164 of the bracket 14. It should be noted that one bearing portion 163 has a larger width than the other bearing portion 164.

The bushes 161 each comprise an axially extending portion 161*a*, which has a cylindrical shape and through which the pivot shaft 15 is passed, and a flange-shaped, radially extending portion 161*b* provided at one end of the axially extending portion 161*a*. The bushes 161 are formed of a synthetic resin material that can produce a desired frictional force in conjunction with associated members. A pair of such bushes 161 are fitted into respective openings of a bearing bore 168 formed in the bearing portion 162 of the tiller handle 5.

A pair of inner and outer nuts 171, 172 are engaged with the threaded portion 166 of the pivot shaft 15 wherein the nuts 171, 172 are pressed against each other and function in a double-nut fashion to lock the engagement. Particularly, in this embodiment, the nuts 171, 172 are provided on a side opposite to the outlet 174 for the shift cable 51, throttle cable 56 and wire harnesses 58 (connecting members). The nuts 171, 172 each have a hexagonal cross-section. The head portion 165 of the pivot shaft 15 is partially received in a recess 177 formed in an end surface surrounding an opening of a bearing bore 176 of the bearing portion 164 disposed on a side opposite to the nuts 171, 172 such that the head portion 165 can rotate relative to the bearing portion 164.

An outer end surface 163*a* of the bearing portion 163 disposed on a side adjacent to the nuts 171, 172 is formed with an opening of a bearing bore 179 adapted to unrotatably receive the inner nut 171. Further, a collar (intervening member) 181 is disposed in the bearing bore 179 and fitted over the pivot shaft 15 to transmit the tightening force of the nut 171 to the bushes (friction members) 161. A nut receiving portion 182 of the bearing bore 179 for receiving the inner nut 171 therein has a hexagonal cross-section complementary to that of the nut 171. The collar 181 has a cylindrical shape and is received in a collar receiving portion 183 of the bearing bore 179 wherein the collar receiving portion 183 has a circular cross-section to allow relative rotation of the collar 181. It should be noted that the nut receiving portion 82 if provided with an abundant axial dimension so as not to limit an axial movement of the nut 71 at the tightening process A washer (wave washer) 185 is interposed between the nut 171 and the collar 181, while a washer (flat washer) 186 is interposed between the collar 181 and the bush 161. Further, a washer (flat washer) 187 is interposed between the bearing portion 164 and the head portion 165 of the pivot shaft 15.

The tiller handle 5 can be made by casting an aluminum alloy material such that the housing 26 and the bearing portion 162 are unitary. Also, the bracket 14 as well as the collar 181 can be preferably made by casting an aluminum alloy material.

In the hinge structure constructed as above, when the head portion 165 of the pivot shaft 15 is turned with a prescribed torque in a tightening direction with the nut 171 being fitted in the bearing bore 179, the tightening force is applied to the washer 186 via the collar 181, whereby the washer 186, radially extending portions 161*b* of the bushes 161, side surfaces of the bearing portion 162 of the tiller handle 5, and side surface of one bearing portion 164 of the bracket 14 are pressed with each other. Also, the inner surface of the bearing bore 168 of the tiller handle 5, axially extending portions of the bushes 161, and outer surface of the pivot shaft 15 are pressed with each other. These create a frictional holding force for retaining the tiller handle 5 against a rotating force produced by the weight of the tiller handle 5. The tiller handle 5 may be rotated smoothly if an operational rotating force beyond the frictional holding force is applied to the tiller handle 5.

In an assembly process, the bushes 161 are fitted in the bearing portion 162, which is then interposed between the bearing portions 163, 164 of the handle bracket 14 so that the bearing bores 168, 176 and 179 are aligned with each other, and further, the washer 186 is fitted in a position. The collar 181 and the inner nut 171 are fitted in the bearing bore 179 from the opening in the outer end surface 163*a*. Then, the pivot shaft 15 is inserted from the side on the bearing portion 164 and rotated to tighten the structure with a tool engaged to the head portion 165 of the pivot shaft 15. The tightening force is adjusted to provide an appropriate resist force against a rotating operation. After the adjustment of the tightening force, the outer nut 172 is tightened to create a double nut effect for maintaining the desired tightening force for an extended period of time.

In this hinge structure, bearing sections for substantially achieving the bearing function are formed substantially symmetrically with respect to a center line 191 of the bearing portion 162 of the tiller handle 5 fitted with the bushes 161. Specifically, in the bearing portion 162 of the tiller handle 5, a part along the extension of the bushes 161 constitutes a bearing section which extends for about the entire length thereof. In one bearing portion 164 of the bracket 14, a part excluding the recess 177 for receiving the head portion 165 of the pivot shaft 15 constitutes the bearing section. In the other bearing portion of the bracket 14, a part which the collar 181 extends along but the threaded portion 166 of the pivot shaft 14 does not overlap constitutes a bearing section.

The bearing sections as a whole are offset from a center line 192 of the joint 116 toward the outlet 174 for the cables 51, 56 and wire harness 58 or toward the center line 132 of the motor main body as a result that the collar 181 as well as the nuts 171, 172 are provided on the side opposite to the outlet 174.

Thus, according to the present invention, the double nut tightening structure prevents the loosening of the nuts, and the inner nut is received in the bearing bore whereby the stable handle holding capability can be ensured for an extended period of time while suppressing increase in the axial dimension which would in turn increase the handle width. Further, the degree of projection of the nut from the side surface of the bearing portion can be minimized, thereby allowing a better appearance around the tiller handle. Also, because the intervening member as well as the nuts are provided on the side opposite to the outlet for the connecting members, it is possible to bring the bearing sections, which substantially carry out the bearing function in the joint, closer to the center line of the motor main body, whereby improving the operability of the tiller handle when it is used in steering operations or pivoted in the upward direction.

Figure 13:
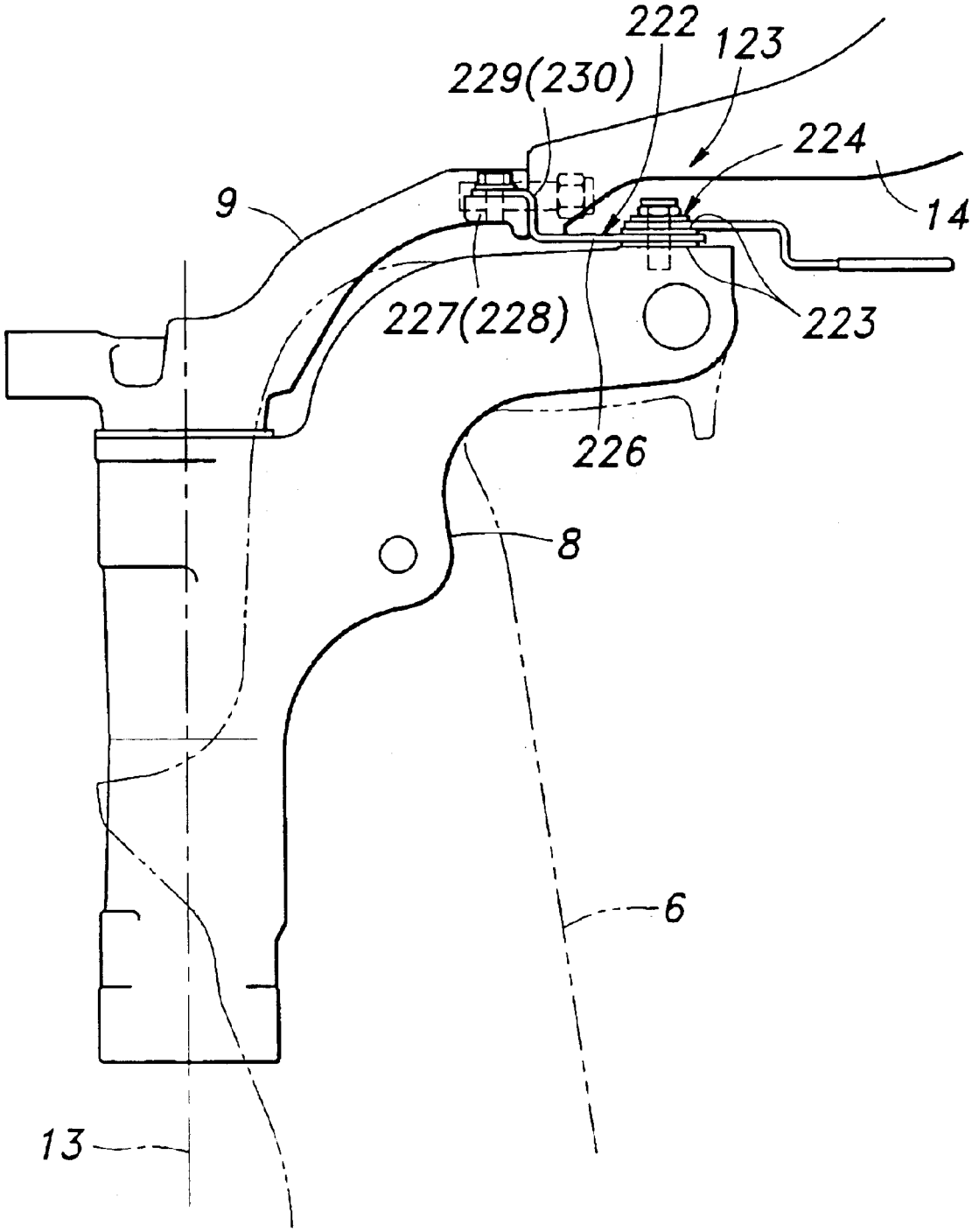
FIG. 13 is a side view for showing a structure around a load adjustment device according to the present invention.
Figure 14:
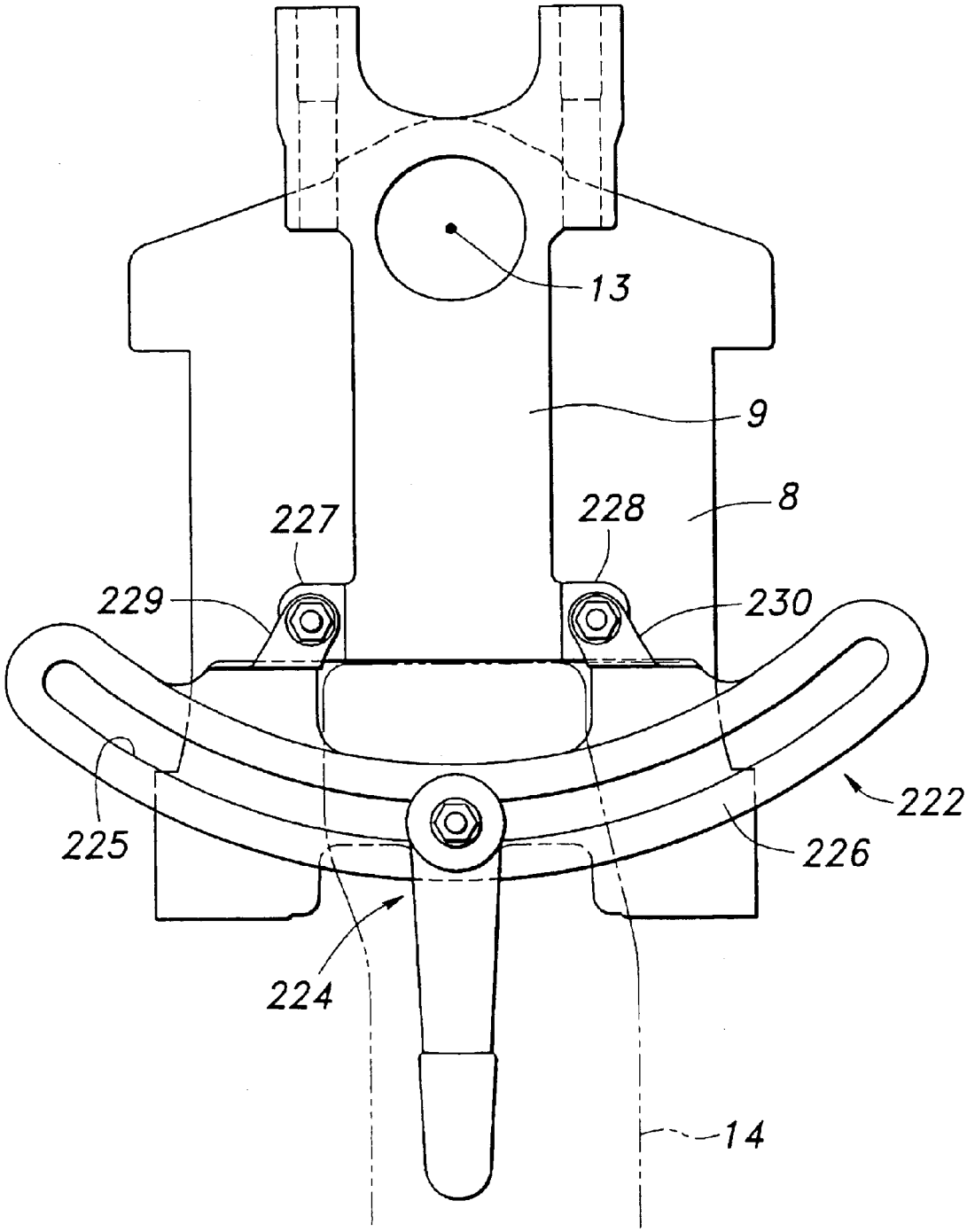
FIG. 14 is a top plan view showing the structure around the load adjustment device shown in FIG. 13.

FIG. 13 is a side view showing a structure around a load adjustment device according to the present invention in detail. FIG. 14 is a top plan view of the structure around the load adjustment device shown in FIG. 13. A load adjustment device 123 for adjusting an operational load in the steering operation conducted using the tiller handle 5 is provided between the swivel case 8 and the mount frame 9. The load adjustment device 123 comprises a slide plate 222 and a slide resistance adjustor 224 for producing a desired slide resistive force by pressing a friction pad (friction member) 223 against the slide plate 222. The slide plate 222 is attached to one (mount frame 9 herein) of the swivel case 8 and the mount frame 9, which can rotate relative to each other around the center axis 13 of the swivel shaft, and the slide resistance adjuster 224 is attached to the other (swivel case 8 herein).

The slide plate 222 can be obtained by cutting a metallic plate made of stainless steel or the like into a prescribed shape, and bending it. The friction pad 223 is made of a synthetic resin material. Particularly, the friction pad 223 can be preferably made of base fibers impregnated with resin matrix and cured/shaped into a prescribe form, such as aramid fibers and graphite fibers impregnated with phenol resin.

As shown in FIG. 14, the slide plate 222 has a main body 226 formed with an arcuate slot 225 about the center line 13 of the swivel shaft, and a pair of left and right attachment portions 229, 230 respectively bolted to a pair of left and right base portions 227, 228 provided to a front end of the mount frame 9. The attachment portions 229, 230 extend out from the main body 226 and are bend in a crank-like shape, as shown in FIG. 13.

Figure 15:
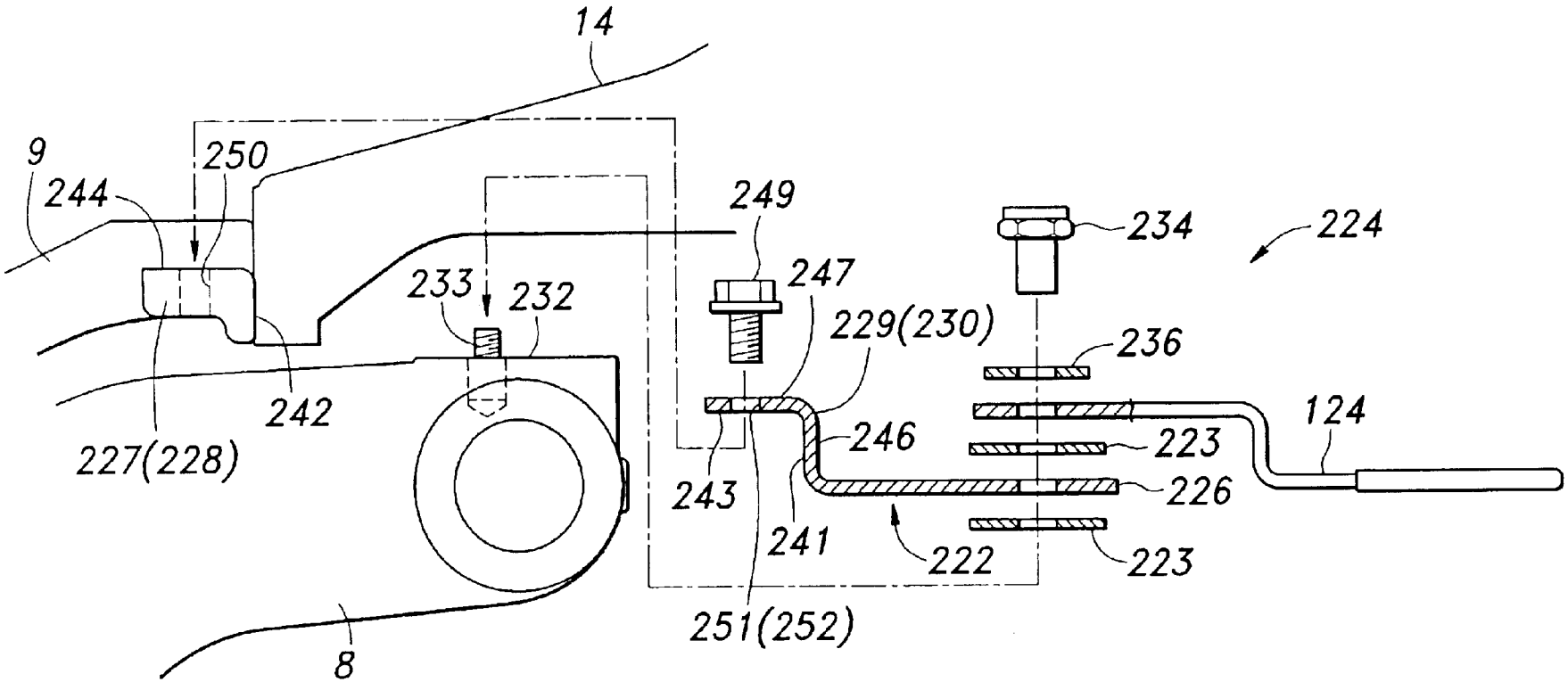
FIG. 15 is an exploded side view of the load adjustment device shown in FIG. 13.

FIG. 15 is an exploded side view showing the load adjustment device of FIG. 13. The slide resistance adjustor 224 is mounted on a bearing surface 232 provided in a front end portion of a top surface of the swivel case 8, and comprises: a pair of friction pads (friction members) 223 vertically interposing the main body 226 of the slide plate 222 therebetween; a self-lock type nut 234 for threadably engaging with a stud bolt 233 embedded in a central portion of the bearing surface 232; an operation lever 124 coupled to the nut 234 so as not to be rotatable relative to the nut 234 and used to adjust the tightening force exerted by the nut 234; and a nylon washer 236 interposed between the operation lever 124 and the nut 234. Thus, by pivoting the operation lever 124 left or right, it is possible to vary the pressure of the friction pads 223 against the slide plate 222, and accordingly increase or decrease the slide resistive force to achieve a desired operational load. The slide resistive force may be so adjusted to restrain the steering movement of the motor main body 4 to thereby fix the motor main body 4 at a desired steering angle.

The slide plate 222 is secured to the base portions 227, 228 formed in the front end of the mount frame 9 in such a manner that the main body 226 is disposed in a plane perpendicular to the center line 13 of the substantially vertical swivel shaft. Further, the top surface (or bearing surface 232) of the swivel case 8 to which the slide resistance adjustor 224 is mounted is also disposed in a plane perpendicular to the center line 13 of the substantially vertical swivel shaft, whereby the friction pads 223 are pressed against the main body 226 of the slide plate 222 in a substantially vertical direction. Thus, if the slide plate 222 were rotated around the center line 13 of the swivel shaft together with the steering movements of the motor main body 4, the state of pressed contact of the friction pads 223 against the main body 226 of the slide plate 222 would not change.

When the slide plate 222 is attached to the base portions 227, 228 provided to the mount frame 9, the attachment portions 229, 230 of the slide plate 222 and the base portions 227, 228 are brought into abutment such that their abutment surfaces 241, 242 for defining a transverse (or horizontal) position contact each other and their abutment surfaces 243, 244 for defining a lengthwise (or vertical) position contact each other, to thereby achieve positioning of the slide plate 222. In the slide plate 222, the abutment surface 241 for defining a transverse position is formed on a rear side of a lengthwise portion (or vertical portion) 246 of each of the attachment portions 229, 230, which makes an L-shape when seen in the side view, while the abutment surface 243 for defining a lengthwise position is formed on an underside of a transverse portion (or horizontal portion) 247 of the same. In each of the base portions 227, 228, the abutment surface 242 for defining a transverse position is formed on a frontal side while the abutment surface 244 for defining a lengthwise position is formed on an upper side.

The upper side abutment surfaces 244 of the base portions 227, 228 are each formed with a bolt receiving threaded hole 250 into which a bolt 249 for securing the attachment portions 229, 230 of the slide plate 222 to the base portions 227, 228 is threadably received, and correspondingly, the transverse portion 247 of each of the attachment portions 229, 230 is formed with a bolt passage hole 251, 252 through which the bolt 249 is passed.

When the abutment surfaces 241, 243 of the attachment portions 229, 230 of the slide plate 222 are brought into contact with the abutment surfaces 242, 244 of the base portions 227, 228, the position of the slide plate 222 with respect to the base portions 227, 228 is determined by the two pairs of surfaces, and thus, by just adjusting the position in a left-right direction along the abutment surfaces 241–244, it is possible to bring the slide plate 222 to an attachment position where the bolt receiving threaded holes 250 of the base portions 227, 228 are aligned with the bolt passage holes 251, 252 of the slide plate 222. Further, when the base portions 227, 228 and the slide plate 222 are secured to each other by the bolts 249, the abutment surfaces 243, 244 serve to define the lengthwise (or vertical) attachment position of the slide plate 222, and hence define the attachment position of the friction pads 223 of the slide resistance adjustor 224 in the direction of pressing, whereby allowing the slide plate 222 to be assembled with the slide resistance adjustor 224 with high precision.

Figure 16:
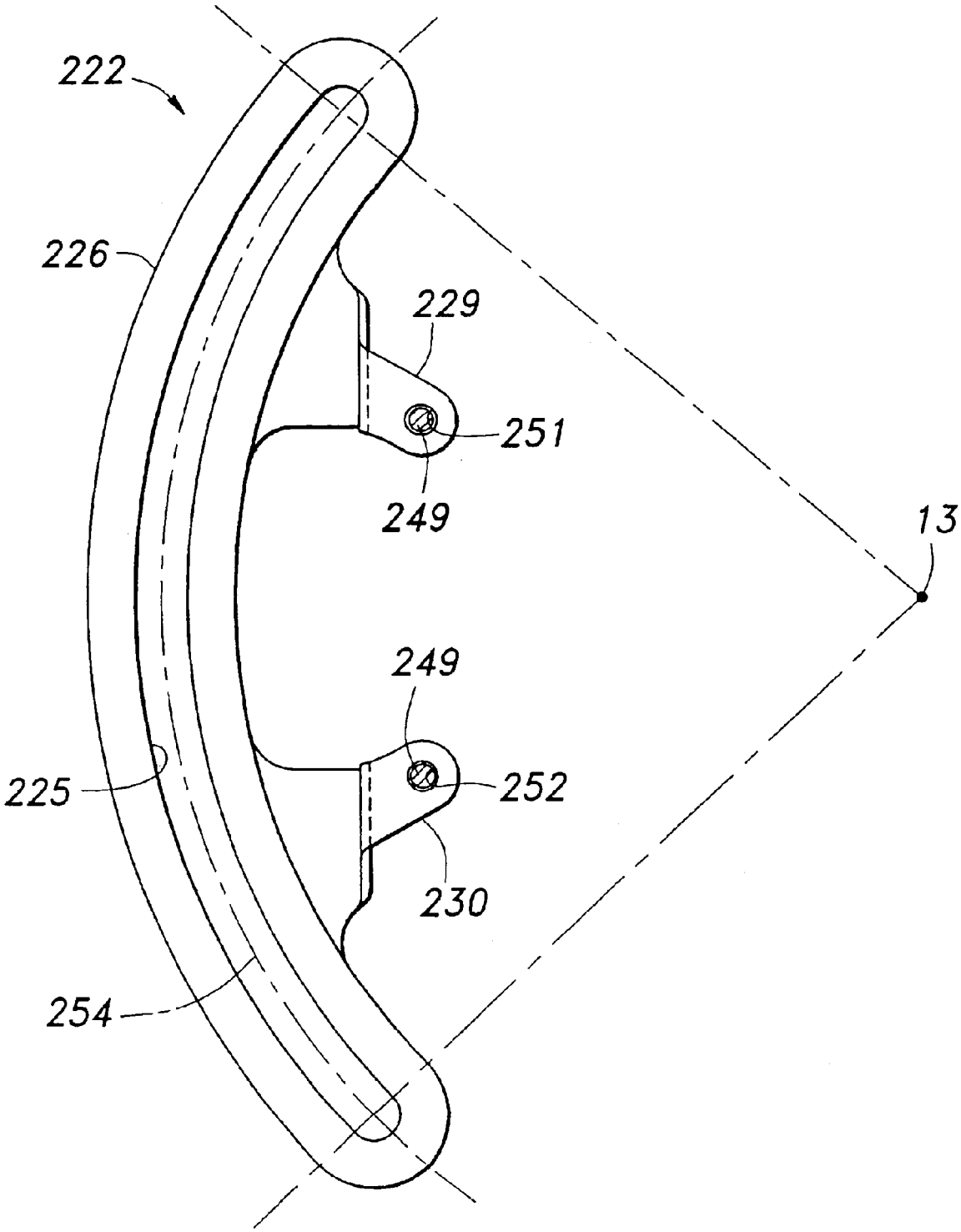
FIG. 16 is a top plan view showing the slide plate of the load adjustment device of FIG. 13 in detail.

FIG. 16 is a top plan view showing the slide plate of the load adjustment device of FIG. 13 in detail. If a center line 254 of the arcuate slot 225 provided to the slide plate 222 is significantly displaced from a center of the slide resistance adjustor 224, a component part of the slide resistance adjustor 224 inserted into the slot 225 will contact a wall defining the slot 225 and thus a smooth movement will be hindered. Therefore, after the slide plate 222 is preliminarily secured by the bolts 249, the transverse attachment position of the slide plate 222 is fine adjusted so that the center line 254 of the slot 225 rests on an arc extending around the center line 13 of the swivel shaft.

The transverse fine adjustment of attachment position of the slide plate 222 is allowed by an adjustment margin provided by a space between each of bolt passage holes 251, 252 formed in the attachment portions 229, 230 of the slide plate 222 and a shaft of the respective bolts 249, and can be carried out in a state that the slide plate 222 is preliminarily fixed by the preliminary tightened bolts 249, whereby permitting quick and precise adjustment.

More specifically, the bolt passage hole 252 formed in one attachment portion 230 of the slide plate 222 assumes a circular shape having a slightly larger diameter than an outer diameter of the shaft of the bolt 249 to create a predetermined play between the passage hole 252 and the shaft of the bolt 249, while the bolt passage hole 251 formed in the other attachment portion 229 has an oblong shape extending in the fore-and-aft direction, so that by pivoting the slide plate 222 around the bolt 249 associated with the attachment portion 230, the fine adjustment of transverse position of the slide plate 222 can be achieved. Preferably, the bolt passage hole 251 has an oval shape having linear longitudinal side walls, or alternatively, has arcuate longitudinal side walls extending around the other bolt passage hole 252.

Thus, according to the present invention, the position of the slide plate with respect to the base portions can be determined by two pairs of surfaces, and thus, by just adjusting the position in a direction along the abutment surfaces, the slide plate can be brought to a predetermined attachment position, whereby reducing the assembly time as well as manufacturing cost. Further, the abutment surfaces can also define the attachment position of the slide plate in a direction corresponding to the direction of pressing of the friction members against the slide plate, to thereby facilitate control of the attachment position of the slide plate in the direction of pressing. This can considerably contribute to achieving an appropriate amount of operational load and smooth steering operation.

Although the present invention has been described in terms of preferred embodiments thereof, it is obvious to a person skilled in the art that various alterations and modifications are possible without departing from the scope of the present invention which is set forth in the appended claims.

What is claimed is:

1. An outboard motor, comprising:

a main body equipped with a propulsion propeller and a power source for driving the propeller and steerably attached to a watercraft body;

a tiller handle extending from the main body of the outboard motor toward the watercraft body for use in steering the main body of the outboard motor;

a sensor for sensing a state of the outboard motor; and a display device for electrically showing the state of the outboard motor according to the result of sensing by the sensor, wherein the display device is provided to the tiller handle such that a display surface thereof faces in an oblique upward direction, wherein the display device is provided on an upwardly facing surface of a part of the tiller handle extending in a substantially horizontal direction, wherein the display device is arranged such that the display surface thereof faces toward a free end of the tiller handle, and wherein the display device is placed at a position in the substantially horizontally extending part of the tiller handle close to a base end of the tiller handle.

2. An outboard motor, comprising:

a main body equipped with a propulsion propeller and a power source for driving the propeller and steerably attached to a watercraft body;

a tiller handle extending from the main body of the outboard motor toward the watercraft body for use in steering the main body of the outboard motor;

a sensor for sensing a state of the outboard motor; and a display device for electrically showing the state of the outboard motor according to the result of sensing by the sensor, wherein the display device is provided to the tiller handle such that a display surface thereof faces in an oblique upward direction, wherein the display device is provided on an upwardly facing surface of a part of the tiller handle extending in a substantially horizontal direction, wherein the display device is arranged such that the display surface thereof faces toward an operator when the operator is at a normal operating position, and wherein the display device is located at a position in the substantially horizontally extending part of the tiller handle close to a free end of the tiller handle.

3. An outboard motor, comprising:

a main body equipped with a propulsion propeller and a power source for driving the propeller and steerably attached to a watercraft body;

a tiller handle extending from the main body of the outboard motor toward the watercraft body for use in steering the main body of the outboard motor;

a sensor for sensing a state of the outboard motor; and a display device for electrically showing the state of the outboard motor according to the result of sensing by the sensor, wherein the display device is provided to the tiller handle such that a display surface thereof faces in an oblique upward direction, wherein part of an outer surface of a housing constituting a substantially horizontally extending part of the tiller handle protrudes outwardly to form a projection, and at least part of the display device is received in the projection.

4. A handle of an outboard motor, comprising:

a handle main body;

a bracket extending from a motor main body toward a watercraft body to support the handle main body via a pivot shaft such that the handle main body is pivotable around the pivot shaft in an up-down direction;

a friction member fitted on the pivot shaft to create a desired frictional force against the pivoting movement of the handle main body in response to a tightening force along an axis of the pivot shaft; and a pair of inner and outer nuts engaged to a threaded portion formed in the pivot shaft in a mutually pressing state, wherein an outer end surface of a bearing portion of the bracket on a side where the nuts are disposed is formed with an opening of a bearing bore so as to allow the inner nut to be relatively unrotatably received in the bearing bore, and wherein an intervening member is disposed in the bearing bore and fitted on the pivot shaft to transmit an axial tightening force produced by the nuts to the friction member.

5. A handle of an outboard motor according to claim 4, wherein an outlet for drawing out a connecting member for connecting a component part mounted to the handle main body to a component part in the motor main body is formed in a base portion of the handle main body at a position near the bearing portion, and wherein the nuts are disposed on a side of the bearing portion opposite to the outlet.

6. An outboard motor according to claim 3, further comprising:

a grip attached to the free end of the tiller handle for controlling an opening degree of a throttle valve of the power source; and a member for transmitting an operation of the grip to the throttle valve, wherein the projection of the housing of the tiller handle is provided above the member for transmitting the operation of the grip.

* * * * *